US008366422B2

(12) United States Patent
Sjögren

(10) Patent No.: US 8,366,422 B2
(45) Date of Patent: Feb. 5, 2013

(54) METERING PUMP

(75) Inventor: Jan Sjögren, Färjestaden (SE)

(73) Assignee: Norden Machinery AB (SE)

( * ) Notice: Subject to any disclaimer, the term of this patent is extended or adjusted under 35 U.S.C. 154(b) by 788 days.

(21) Appl. No.: 12/439,797

(22) PCT Filed: Sep. 9, 2007

(86) PCT No.: PCT/SE2007/050634
§ 371 (c)(1),
(2), (4) Date: Jun. 10, 2009

(87) PCT Pub. No.: WO2008/030180
PCT Pub. Date: Mar. 13, 2008

(65) Prior Publication Data

US 2010/0196178 A1 Aug. 5, 2010

(30) Foreign Application Priority Data

Sep. 8, 2006 (SE) ..... 0601870

(51) Int. Cl.
*F04B 39/10* (2006.01)

(52) U.S. Cl. ..... 417/545; 417/415; 141/91; 222/148

(58) Field of Classification Search ..... 417/415, 417/545; 141/90, 91; 222/148
See application file for complete search history.

(56) References Cited

U.S. PATENT DOCUMENTS

| | | | | |
|---|---|---|---|---|
| 3,612,360 | A | 10/1971 | Ambrose et al. | |
| 4,157,057 | A | 6/1979 | Bailey | |
| 4,759,695 | A * | 7/1988 | Bordini | 417/519 |
| 2005/0152787 | A1 * | 7/2005 | Oglesby | 417/18 |

FOREIGN PATENT DOCUMENTS

WO WO-2008/030180 A2 3/2008

OTHER PUBLICATIONS

"International Application Serial No. PCT/SE2007/050634, International Preliminary Report on Patentability and Amended Claims mailed Sep. 17, 2008", 12 pgs.
"International Application Serial No. PCT/SE2007/050634, International Search Report mailed Feb. 25, 2008", 3 pgs.

* cited by examiner

*Primary Examiner* — Charles Freay
*Assistant Examiner* — Patrick Hamo
(74) *Attorney, Agent, or Firm* — Schwegman Lundberg & Woessner, P.A.

(57) ABSTRACT

A metering pump for feeding out viscous materials, which pump comprises a housing having an inlet connectable to a viscous material source, an outlet; and a valve body of cylindrical basic shape, which is rotatable into at least two positions by means of a drive unit including a first position allowing a flow of the material from the inlet to the housing and a second position allowing a flow of the material from the housing to the outlet. The pump also comprises a cylinder device connected to the housing, having a controllable piston intended to achieve the flow of material, and at least one device for cleaning the metering pump. The cleaning device comprises at least one nozzle for cleaning agent, disposed in a valve-body-facing part of the piston. Also, a method for cleaning such a metering pump.

36 Claims, 5 Drawing Sheets

METERING PUMP

RELATED APPLICATIONS

This application is a nationalization under 35 U.S.C. 371 of PCT/SE2007/050634, filed Sep. 7, 2007 and published as WO 2008/030180 A2, on Mar. 13, 2008, which claimed priority under 35 U.S.C. 119 to Sweden Patent Application Serial No. 0601870-9, filed Sep. 8, 2006; which applications and publication are incorporated herein by reference and made a part hereof.

TECHNICAL FIELD

The invention relates to a metering pump for metering or filling materials of different kinds into a container or the like. The invention especially relates to a method and an arrangement for cleaning components incorporated in the metering pump.

BACKGROUND ART

Metering pumps and similar apparatuses for metering and feeding out different types of fluid materials can require cleaning in order to remove material which has been deposited on components in the pump or in order to prepare the pump for feeding out another material. It is desirable to be able to clean the metering pump without it needing to be dismantled, with a view to saving time and being able to carry out rapid changes of material.

U.S. Pat. No. 4,759,695 discloses an example of an arrangement for in situ cleaning of a metering pump. This pump comprises an inlet, an outlet and an intervening rotatable valve. Material is fed in and out by the action of a cylinder, the piston of which faces an opening in the valve. A cone-shaped front part of the valve bears sealingly against an interacting conical seat in the valve-facing end of the cylinder. In a first position, the valve is open towards the inlet, the piston being actuated to suck material into the cylinder from the inlet. After this, the valve is rotated into a second position, in which the piston can force the material out through the outlet. When the pump is to be cleaned, the cone-shaped section of the valve is drawn out of engagement with the conical seat with a view to achieving a direct connection between inlet and outlet. A cleaning liquid can hereupon be flushed through the metering pump for cleaning of the valve. One problem with this solution is that material residues can be left, since the through-flow substantially passes by the front section of the valve.

U.S. Pat. No. 4,842,026 discloses a further example of an arrangement for in situ cleaning of a metering pump. This pump has a similar structure, having a rotatable valve and a piston-cylinder device for the feed-in and feed-out of material. In connection with the cleaning, cleaning liquid is flushed firstly through a nozzle in the inlet and secondly towards an inner end face of the valve via a separate nozzle. During the cleaning, the valve can also be rotated for the removal of further material. This arrangement, too, creates problems with left-over material residues, since the flow from the said nozzles does not reach the whole of the space which is to be cleaned.

The object of the invention is to provide a method for achieving more effective and faster cleaning of a metering pump and an arrangement for implementing the method. The invention also relates to an improved arrangement which allows in situ cleaning of all the components incorporated in the metering pump, without these needing to be disassembled.

DISCLOSURE OF INVENTION

The problems above are solved by an arrangement and a method according to the below-stated patent claims.

According to a preferred embodiment, the invention relates to a metering pump for feeding out viscous materials, which pump comprises a housing having an inlet, connectable to a viscous material source, and an outlet. Between the inlet and the outlet there is a valve body of cylindrical basic shape, which is rotatable into at least two positions by means of a drive unit. According to one example, the drive unit can be constituted by a mechanism for transmitting a mechanical motion between the first and the second position. Alternatively, the motion can be realized by a servo motor, a step motor or some other suitable drive unit. Such a drive unit can be electrically, pneumatically or hydraulically operated. The valve body is provided with cavities and openings or ducts to allow the viscous material to be fed through the metering pump. In connection with the metering of material, the rotatable valve body can preferably be set in two fixed positions, a first position allowing a flow of the said material from the inlet to the housing and a second position allowing a flow of the said material from the housing to the outlet. According to one embodiment, the valve body is mounted rotatably relative to the housing in at least two axially separate positions along the valve body, preferably, but not necessarily, adjacent to the ends of the valve body. According to this embodiment, the inlet can be connected to an axial section of the valve body, whilst the outlet is connected to a radial section of the valve body.

A cylinder device connected to the housing is provided with a controllable piston intended to achieve the said flow of material. According to one embodiment, the cylinder device is connected to a radial section of the valve body. In this case, the valve body can preferably be mounted rotatably relative to the housing on each side of the connection of the cylinder device to the housing. With the valve body in its first position, the piston is displaced over a predetermined distance in the direction away from the valve body, whereupon material is sucked from the inlet into the cylinder device. When the quantity of material which is to be fed out has been drawn into the cylinder device, the piston is halted. The valve body is subsequently rotated into its second position and the piston is forced back in the direction of the valve body. Once the piston reaches its end position adjacent to the housing and the cylinder device contains a desired quantity of material, this material is forced out through the outlet and further into a filling nozzle or the like. Filling nozzles of this type are not part of the present invention and will not be described in detail.

In connection with the cleaning of the metering pump, the drive unit can be used to achieve a step-by-step or continuous rotation of the valve body to allow cleaning agent, at least intermittently, to be conducted out through the outlet. Alternatively, the drive unit can set the valve body in an intermediate position, between the said first and second positions. The openings and cavities of the valve body are in this case placed such that a flow of cleaning agent can take place from the inlet and past the valve body to the outlet. The metering pump can be provided with at least one device for cleaning the parts incorporated in the pump, without the pump needing to be dismantled. A first cleaning device comprises at least one nozzle for cleaning agent, disposed in a valve-body-facing part of the piston.

The type of cleaning agent which can be used depends, for example, on the type of viscous material which is to be removed. The cleaning agent can be constituted by, for example, cold or hot water, dishwashing detergent, alcohol or steam, the agent being fed under pressure through the valve body of the metering pump, alternatively the valve body and at least a part of the cylinder device.

In the following text, terms such as "front" and "rear" and "forwards" and "rearwards" are used to define the relative position and movement of the various components along the longitudinal axis of the cylinder device. Thus, the front section of the cylinder device bears against the housing of the metering pump.

When viscous materials are fed out, the nozzle is preferably disposed in a retracted position in the piston. The front face of the piston, facing the valve body, is therefore substantially flat and the nozzle is protected from the viscous material. According to a preferred exemplary embodiment, the nozzle is configured such that it is pressed into sealing contact against a seal in the piston of the viscous material.

During cleaning of the metering pump, a first nozzle for cleaning agent is disposed in the inlet. In a first, optional step, the first nozzle can flush clean the majority of the viscous material from the inlet opening and cavities in the valve body adjacent to the cylinder device. At least a second nozzle can be disposed in an extensible position in the piston, the nozzle preferably being able, in the extended position, to be directed towards the valve body. The nozzle is preferably disposed on one end of a rod running concentrically inside the piston rod of the piston. The rod can therefore be moved together with the piston and the piston rod when viscous material is fed out.

During cleaning of the metering pump, the nozzle can be axially displaced, by means of the rod, relative to the front face of the piston in order to supply cleaning agent through the piston rod and the nozzle. During subsequent cleaning steps, the nozzle first flushes clean in the cavity which is normally facing the cylinder device and, thereafter, the cavity which is normally facing the outlet, during rotation of the valve body. The valve body can be rotated continuously or in steps in order to expose the cavities to the nozzle and to evacuate the cleaning agent through the outlet during both the first and the second step. It is also possible to have the first step carried out separately, alternatively to carry out the first and the second step simultaneously.

According to one exemplary embodiment, the nozzle is pushed axially forwards relative to the front face of the piston, whereupon a number of bores for the supply of cleaning agent are exposed. The nozzle can comprise a front section with relatively flat face, which is intended to coincide with the front face of the piston in the retracted position. Moreover, the nozzle can comprise a rear section of substantially conical basic shape, a front conical face being intended to bear sealingly against a corresponding face in the piston. The rear section can be provided with a number of radial and/or angled bores, which run between a central duct in the rod and the outer periphery of the rear conical section. According to one example, the periphery of the rear conical section can be provided with at least one outer radial groove in which the bores emerge. Alternatively, the conical section can be provided with a plurality of grooves, the bores having the same angle relative to the centre axis of the rod emerging in the same groove. Preferably, bores directed towards the valve body should emerge in grooves closer to the end face of the nozzle than bores directed at right angles to the centre axis of the rod. By operation of an actuator on the rear end of the cylinder device, the rod can be pushed forwards, whereupon the nozzle is pushed out of the front face of the piston. As a result, the nozzle with one or more sets of bores is exposed, and the pump, and at least parts of the cylinder device, can be flushed clean. The piston can be disposed at a predetermined distance from the valve body to allow jets from the bores to strike certain defined faces of a stationary valve body. Alternatively, the valve body can be continuously rotated so that the jets of cleaning agent can reach a larger area of the valve body. The piston can also be arranged to be displaceable in the direction towards and/or away from the valve body during cleaning of the metering pump. This movement can be made continuously or in several steps in one or both directions. A plurality of jets with constant direction can here reach different parts of the valve body, especially if this is simultaneously rotated as the distance between nozzle and valve body is varied.

According to an alternative exemplary embodiment, the rod can be rotated about its centre axis, or the front part of the nozzle comprising the conical section can be arranged to be rotated during the cleaning. An embodiment comprising a rotary nozzle with jets at different angles in combination with displacement of the piston in the direction of a rotatable valve body allows an effective flushing of both the inner face of the cylinder device and the outer face of the valve body.

According to a further alternative exemplary embodiment, a solid nozzle is pushed axially forwards relative to the front face of the piston, whereupon an annular gap forms a nozzle in the form of a ring nozzle. The ring nozzle will produce a conical, annular jet of cleaning agent. According to this example, the nozzle is provided with cleaning agent via a gap between the piston rod of the cylinder device and the rod controlling the motion of the nozzle. The piston can be disposed at a predetermined distance from the valve body to allow the jet to strike certain defined faces of a stationary valve body. Alternatively, the valve body can be rotated continuously, so that the jet of cleaning agent can reach a larger area of the valve body. The piston can also be disposed so as to be displaceable in the direction of the valve body during cleaning of the metering pump. This movement can be made continuously or in several steps. A conical, annular jet of constant shape can here reach different parts of the valve body as the distance between nozzle and valve body is varied. Alternatively, the shape of the jet can be altered by adjusting the protrusion of the nozzle from the piston, which controls the size of the gap, or by varying the pressurization of the cleaning agent. It is also possible, of course, to simultaneously vary the shape of the jet and the distance to the valve body.

According to a further alternative exemplary embodiment, the nozzle can be pushed axially rearwards relative to the front face of the piston in order to supply cleaning agent during the cleaning process. According to this example, a front peripheral face of a solid nozzle is pressed axially forwards so as to bear sealingly against a corresponding annular inner face in an inner cavity in the piston. The annular inner face comprises a cavity in the front face of the piston, an annular gap forming a nozzle in the form of a ring nozzle when the nozzle and the rod are displaced axially rearwards in the piston rod. According to this example, the nozzle is provided with cleaning agent via a gap between the piston rod of the cylinder device and the rod controlling the motion of the nozzle. The shape and direction of the jet can be controlled by varying the distance between the front peripheral face of the nozzle and the annular inner face in the cavity in the piston and/or the pressurization of the cleaning agent.

In order to be able to reach as large an area of the valve body as possible with one of the above-described nozzles, the size of the nozzle should be adapted to the shape and size of the piston. A choice of suitable distance between nozzle and valve body is also dependent on the cone angle of the ring nozzle, available pressure for the cleaning agent, and the configuration of the connection opening of the cylinder device to the housing. A relatively small opening between the cylinder device and the housing means that the nozzle should be placed at a fixed distance, relatively close to the valve body.

When the flushing of the valve body, alternatively the valve body and the inner side of the cylinder device, is finished, the said first and second nozzle can be used to dry the cylinder and the valve body. Expediently, a suitable gas, such as air, nitrogen gas or the like, can be blown through the metering pump. In this way, a shorter set-up time can be obtained.

The invention also relates to a piston for a cylinder device intended to achieve a flow of viscous material in a metering pump for feeding out the said material. The piston comprises at least one cleaning device for the supply of cleaning agent for cleaning of the metering pump. The pump preferably comprises a housing having an inlet, connectable to a viscous material source, and an outlet; a valve body which can be set in at least two positions, a first allowing a flow of the said material from the inlet to the housing and a second allowing a flow of the said material from the housing to the outlet; the cylinder device being connected to the housing in order to achieve the said flow of material.

The cleaning device of the piston comprises at least one nozzle for cleaning agent, disposed in a front part, facing the valve body, of the piston. The nozzle is preferably disposed in a retracted position in the piston when viscous materials are fed out, and disposed in an extended position in the piston while the metering pump is cleaned. At least one nozzle can be directed towards the valve body in the extended position. Moreover, at least one nozzle, in the extended position, can be directed towards an inner face of the cylinder device.

During cleaning of the metering pump, the piston can be disposed at a predetermined distance from the valve body. Alternatively, the piston can be displaceable in the direction of the valve body during cleaning of the metering pump. Such a movement of the piston can be made continuously or in several steps. The piston can here be displaced from a predetermined distance from the valve body or from a first end position to a second end position in the cylinder device in the direction of the valve body.

The nozzle is preferably disposed at one end of a through-rod which is axially pushable in a piston rod in the cylinder device, which nozzle can be pushed out of the front face of the piston. According to a preferred exemplary embodiment, the nozzle is pushed axially forwards relative to the front face of the piston, whereupon a number of bores for the supply of cleaning agent are exposed. The nozzle can comprise a front section with relatively flat face, which is intended to coincide with the front face of the piston in the retracted position. Moreover, the nozzle can comprise a rear section of substantially conical basic shape, a seal in the form of a front conical face being intended to bear sealingly against a corresponding face in the piston. The rear section can be provided with a number of radial and/or angled bores, which run between a central duct in the rod and the outer periphery of the rear conical section. According to one example, the periphery of the rear conical section can be provided with at least one outer radial groove in which the bores emerge. Alternatively, the conical section can be provided with a plurality of grooves, the bores having the same angle relative to the centre axis of the rod emerging in the same groove. Preferably, bores directed towards the valve body should emerge in grooves closer to the end face of the nozzle than bores directed at right angles to the centre axis of the rod. The angle of the bores relative to the centre axis depends on their function during the cleaning. Bores intended to clean the valve body are preferably placed along the front part of the rear section. These are directed forwards and can be given an angle of between 90° and the cone angle of the rear section relative to the centre axis of the rod. Bores intended to clean the inner face of the cylinder device, and also the front face of the piston, are preferably placed along the rear part of the rear section. These are directed outwards and can be angled at 90°, alternatively between 90° and 70°, relative to the centre axis of the rod, provided that this does not disturb jets situated in front thereof. It is also conceivable to angle the rearmost bores obliquely rearwards in order to be able to flush the front face of the piston.

By operation of a control unit on the rear end of the cylinder device, the rod can be pushed forwards, whereupon the nozzle is pushed out of the front face of the piston. As a result, the nozzle with one or more sets of bores is exposed, and the pump, and at least parts of the cylinder device, can be flushed clean. According to one exemplary embodiment, the piston can be disposed at a predetermined distance from the valve body to allow jets from the bores to strike certain defined faces of a stationary valve body. Alternatively, the valve body can be continuously rotated so that the jets of the cleaning agent reach a larger area of the valve body. The piston can also be arranged to be displaceable relative to the valve body during cleaning of the cylinder device of the metering pump. This movement can be made continuously or in several steps along the whole or parts of the length of the cylinder device. A plurality of jets with constant direction can here reach, broadly speaking, the whole of the valve body, especially if this is simultaneously rotated as the distance between nozzle and valve body is varied. It may also be possible to have the piston move to and fro in the cylinder device during the cleaning process. As has been stated above, the valve body can preferably be rotated continuously or in steps throughout the cleaning process in order to evacuate cleaning agent through the outlet.

According to a further exemplary embodiment, the control unit can be arranged to rotate the rod about its centre axis. Alternatively, the front part of the nozzle comprising the conical section with bores can be arranged to be rotated during the cleaning. The latter example can be achieved by the bores being placed tangentially, the pressurized cleaning agent setting the nozzle in rotation. An embodiment, comprising a rotary nozzle with jets at different angles in combination with displacement of the piston in the direction of a rotatable valve body allows an effective flushing of both the inner face of the cylinder device and the outer face of the valve body.

The invention also relates to a method for cleaning the above-described metering pump. The metering pump comprises a housing having an inlet, connectable to a viscous material source, and an outlet. Between the inlet and the outlet there is a valve body of cylindrical basic shape rotatable into at least two positions by means of a drive unit. The valve body is provided with cavities and openings or ducts to allow the viscous material to be fed from an inlet to an outlet in the metering pump. A cylinder device connected to the housing is provided with a controllable piston intended to achieve the said flow of material.

The method preferably comprises the following steps:

shutting-off of the inlet connected to the viscous material source, controlling of the valve body to allow simultaneous supply of cleaning agent from the inlet and draining-off of cleaning agent through the outlet, controlling of the nozzle into a position in which the nozzle allows cleaning of the metering pump, connection of the inlet to a pressurized cleaning agent source, connection of the nozzle to a pressurized cleaning agent source, flushing of the valve body and at least a part of the cylinder device.

According to one exemplary embodiment, the method comprises controlling of the valve body by continuous or step-by-step rotation of the latter in order intermittently to connect the inlet and the outlet. This allows cleaning agent to run out of the valve body each time an opening or a cavity in the valve body passes the outlet of the metering pump. According to an alternative exemplary embodiment, the method comprises controlling of the valve body into an intermediate position which connects the inlet and the outlet. This allows cleaning agent to be flushed freely past the valve body during the cleaning. A precondition for the latter example is that the cavities of the valve body are configured such that the said cavities can be positioned so that at least some part is simultaneously exposed to the opening of the cylinder device and the outlet.

The method preferably comprises the opening of a nozzle in the front part, facing the valve body, of the piston. The opening of the nozzle can be realized by the action of a through-rod which is axially pushable relative to a piston rod in the cylinder device. Flushing of the valve body and at least a part of the cylinder device can also be realized with displacement of the piston in the direction of the valve body. In addition to a first step comprising flushing by means of a cleaning agent, the method can also comprise a second step, in which valve body and cylinder device are dried by means of a pressurized gas.

BRIEF DESCRIPTION OF DRAWINGS

The invention will emerge in greater detail from the following description of a preferred illustrative embodiment with reference to the appended schematic drawings, wherein.

MODES FOR CARRYING OUT THE INVENTION

Figure 1:
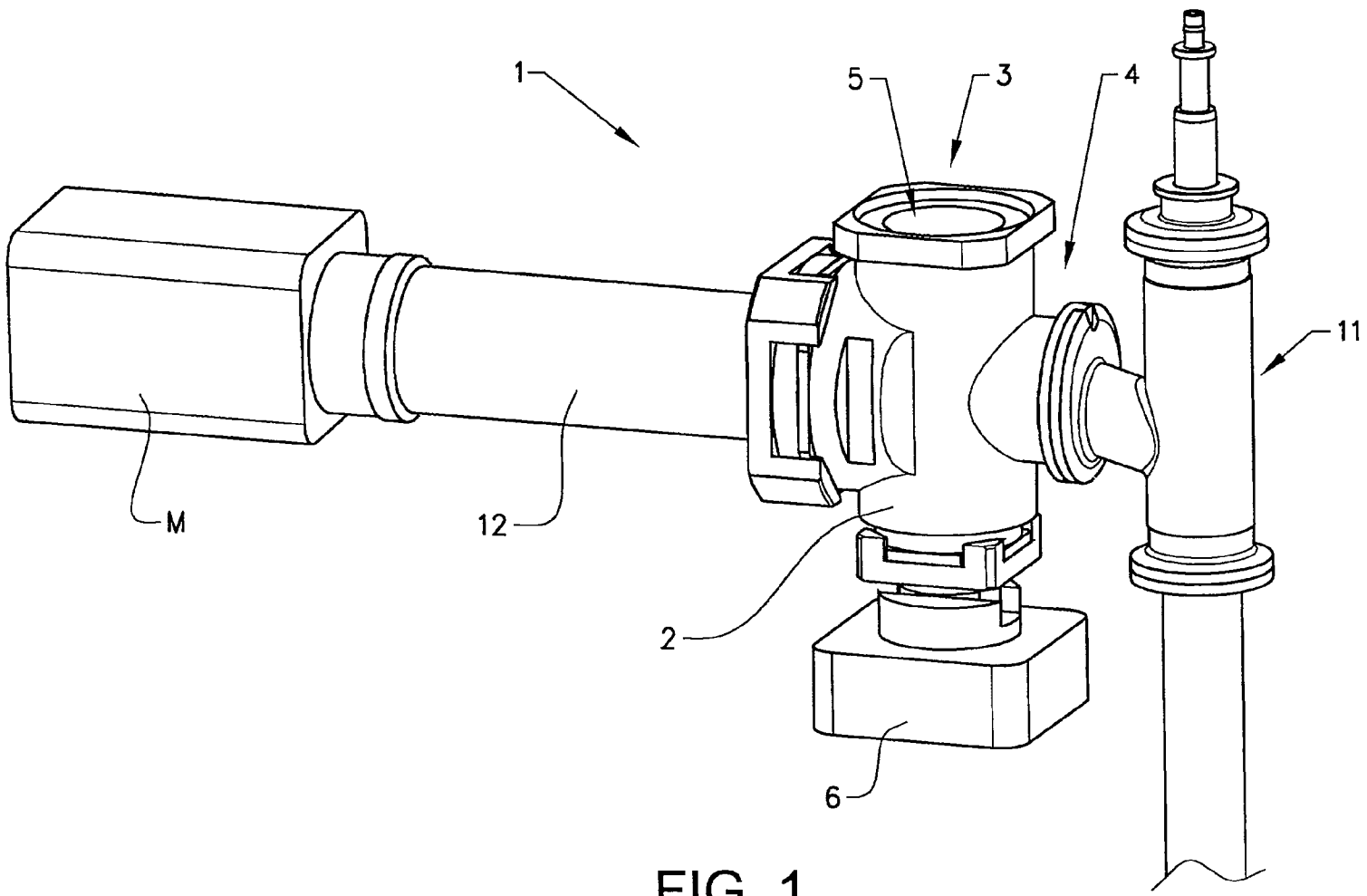
FIG. 1 shows a perspective view of a metering pump according to the invention.
Figure 2:
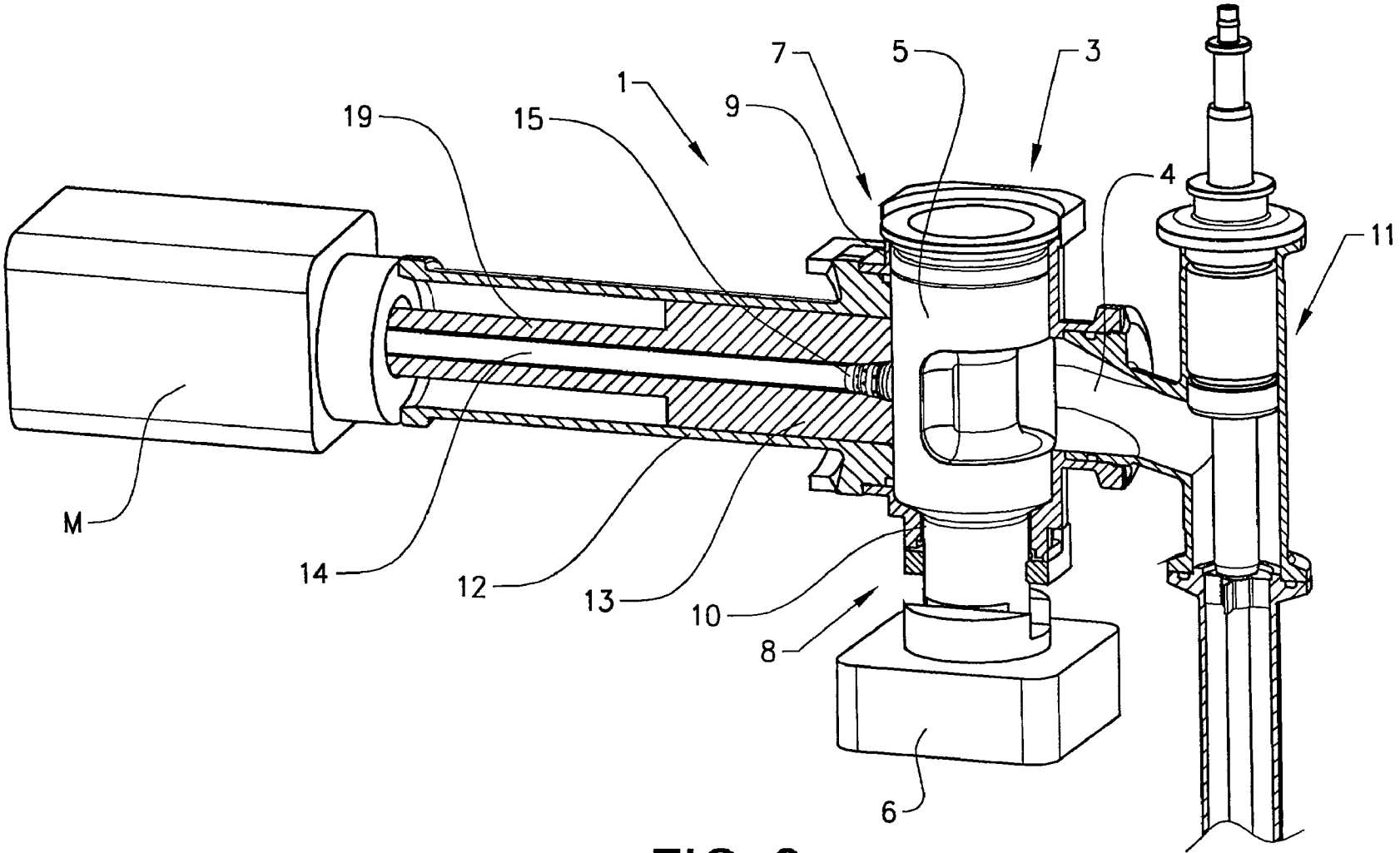
FIG. 2 shows a partially cut view of a cylinder of the metering pump according to FIG. 1.

FIG. 1 shows a perspective view of a metering pump 1 according to a preferred embodiment of the invention and FIG. 2 shows a partially cut view of this pump. The metering pump 1 is intended for feeding out viscous materials, such as soft cheese, caviar, hair gel, shampoo, lotion, liquid soap or the like. The pump 1 comprises a housing 2 having an inlet 3, connectable to a container for viscous material (not shown), and an outlet 4. Between the inlet 3 and the outlet 4 there is a cylindrical valve body 5 (see FIG. 2), which is rotatable into at least a first and a second position by means of a drive unit 6. The drive unit 6 is constituted by a mechanism for transmitting a mechanical motion between the first and the second position. Alternatively, the mechanism can be replaced by a servo motor or a step motor. The valve body 5 is provided with cavities and openings (see FIG. 3) to allow the viscous material to be fed through the metering pump 1. In connection with the metering of material, the rotatable valve body 5 can be set in two fixed positions, a first position allowing a flow of the said material from the inlet 3 to the housing 2 and a second position allowing a flow of the said material from the housing 2 to the outlet 4. The valve body 5 is mounted rotatably relative to the housing 2 adjacent to the upper and lower ends 7, 8 of the valve body 5. The mounting is here constituted by sealing plain bearings 9, 10. According to this embodiment, the inlet 3 is connected in the axial direction to an upper section of the valve body 5, whilst the outlet 4 is connected in the radial direction to a section of the side face of the valve body 5. The outlet 4 is angled downwards and is connected to a vertically disposed filling nozzle 11. This type of filling nozzle is not part of the present invention and will not be described in detail.

A cylinder 12 connected to the housing is provided with a controllable piston 13 (see FIG. 2) intended to achieve the said flow of material. As can be seen from FIG. 1, the cylinder 12 is connected to a radial section of the valve body 5 on a diametrically opposite side of the outlet 4. With the valve body 5 in its first position, the piston 13 is displaced by a predetermined distance in the direction from the valve body 5, whereupon material is sucked from the inlet 3 into the cylinder 12. When the quantity of material to be fed out by the filling nozzle 11 has been drawn into the cylinder 12, the piston 13 is halted. The valve body 5 is thereafter rotated into its second position and the piston 13 is forced back in the direction of the valve body 5. Once the piston 13 reaches its end position adjacent to but not in contact with the valve body 5, the desired quantity of material is forced out through the outlet 4 and further into the filling nozzle 11 for filling of a container (not shown).

FIG. 2 further shows a rod 14 displaceable in the piston 13 and having a nozzle 15 for the supply of cleaning agent at its end facing the valve body 5. An operating member M is mounted on the outer end of the cylinder 12, which operating member M can be controlled to displace the piston 13 into the desired position in the cylinder 12, and the nozzle 15 into the desired position relative to the piston 13.

In the following text, terms such as "front" and "rear" and "forwards" and "rearwards" are used to define the relative position and movement of the various components along the longitudinal axis of the cylinder device. Thus, the front section of the cylinder device bears against the housing of the metering pump.

Figure 3:
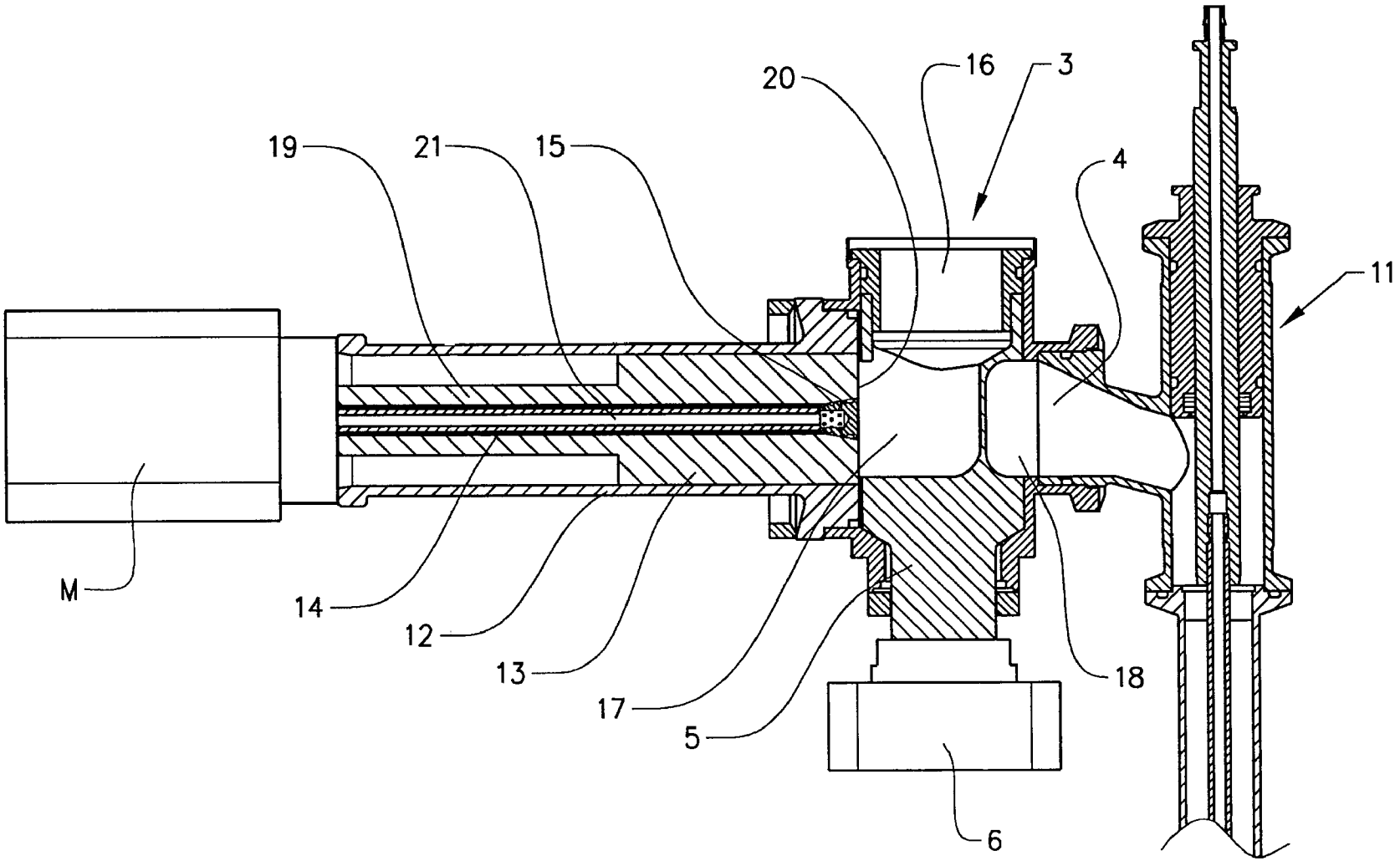
FIG. 3 shows a cross section through the metering pump according to FIG. 2, with the piston in the position prior to filling of the cylinder.

FIG. 3 shows a cross section through the metering pump 1 according to FIG. 2 in a plane through the cylinder 12, with the valve body 5 and the piston 13 in the first position, intended for filling of the cylinder 12. In the first position, the inlet 3 of the valve body 5 is connected to an axial opening 16 communicating with a first radial cavity 17 which is open out towards the front opening, facing the valve body 5, of the cylinder 12. This position allows a flow of viscous material when the piston 13 is drawn rearwards for filling of the cylinder 12. After this, the valve body can be rotated through 90° into its second position (not shown). In this position is a second radial cavity 18, which is disposed diametrically opposite and symmetrically relative to the first cavity 17 in the outer periphery of the valve body. The first cavity 17 extends along the valve body with an included angle of 200°. At the same time, the first cavity 17 is moved into a position between the front opening of the cylinder 12 and the outlet 4. This position allows a flow of viscous material towards the outlet 4 when the piston 13 is pushed forwards for emptying of the cylinder 12.

In connection with the cleaning of the metering pump, the drive unit 6 rotates the valve body 5 continuously, so that the first and the second cavity 17, 18 are alternately exposed to the opening of the cylinder 12 and the outlet 4. The opening 16 and cavities 17, 18 of the valve body are in this case intermittently connected to the outlet 4, so that a flow of cleaning agent can take place from the inlet 3 and past the valve body 5 to the outlet 4. Alternatively, the drive unit 6 can achieve a step-by-step rotation of the valve body 5 to allow cleaning agent, at least intermittently, to be conducted out through the outlet 4. The metering pump 1 is provided with at least one device for cleaning of the parts incorporated in the pump, without the pump needing to be dismantled. A first cleaning device (not shown) comprises a nozzle for cleaning agent, which is connectable to the inlet 3 to flush clean the majority of the viscous material from the opening 16 and the cavity 17 in the valve body 5. A second cleaning device comprises the nozzle 15 for cleaning agent, disposed in a part of the piston 13 facing the valve body 5. The nozzle 15 is disposed on the end, facing the valve body 5, of the rod 14, which rod runs concentrically inside the piston rod 19 of the piston 13. When viscous material is fed out, the rod 14 can thus be moved together with the piston 13 and the piston rod 19. During cleaning of the metering pump 1, the nozzle, by means of the rod 14, can be axially displaced relative to the front face 20 of the piston in order to supply cleaning agent to the nozzle 15 via a central through-duct 21 in the rod 14. The operating member M can be controlled to displace the piston 13 into the desired position in the cylinder 12, and the nozzle 15 into the desired position relative to the piston 13. Moreover, the duct 21 in the rear end (not shown) of the rod 14 is connectable to a pressurized cleaning agent source.

The type of cleaning agent which can be used depends, for example, on the type of viscous material which is to be removed. The cleaning agent can be constituted by, for example, cold or hot water, dishwashing detergent, alcohol or steam, the agent being fed under pressure through the valve body of the metering pump, alternatively the valve body and at least a part of the cylinder.

Figure 4:
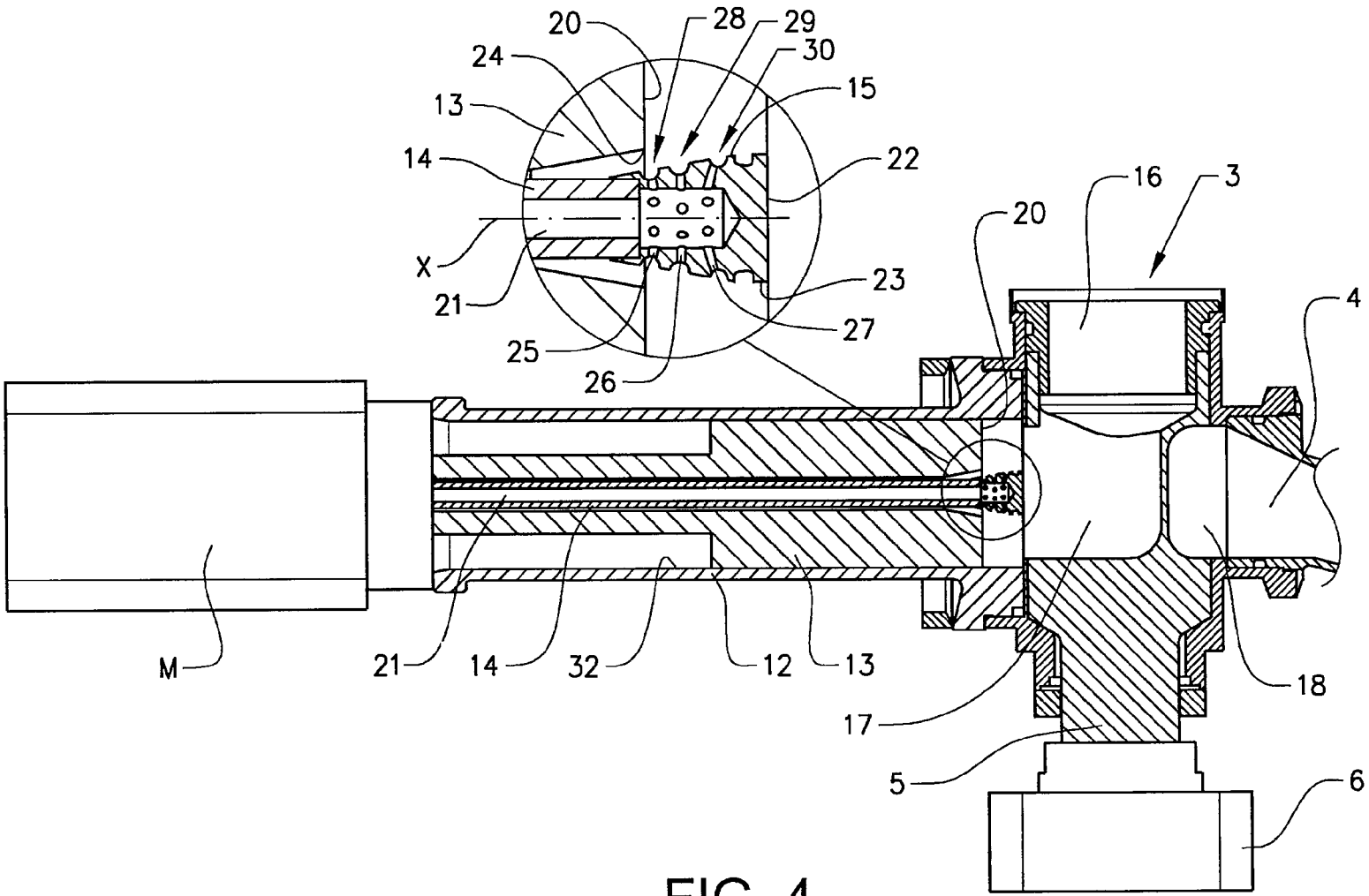
FIG. 4 shows an enlarged view of the cross section in FIG. 3, with the piston in a first position for cleaning.

When viscous materials are fed out, the nozzle 15 is disposed in a retracted position in the piston 13, as can be seen from FIG. 3. The valve-body-facing front face 20 of the piston 13 is therefore substantially flat and the nozzle 15 is protected from the viscous material. FIG. 4 shows an enlarged view of the cross section in FIG. 3, with the piston 13 in a first position for cleaning of the pump 1. During cleaning of the metering pump 1, a first nozzle (not shown) for cleaning agent is connected to the inlet 3, with a view to, in a first step, flushing the majority of the viscous material from the opening 16 and the first cavity 17 in the valve body. The second nozzle 15 is arranged to be pushed out into an extended position in the piston 13 by the action of the rod 14 and/or the piston 13. As can be seen from FIG. 4, the nozzle 15 is for the greater part directed towards the valve body 5 in the extended position, since the piston 13 is positioned close to its front position. FIG. 4 shows an example in which the nozzle 15 is positioned for cleaning of the valve body 5. In order to activate the flushing with the nozzle 15 in this position, the piston 13 must be drawn rearwards over a predetermined distance, whilst the rod 14 is left in its original position. When the piston 13 is drawn rearwards, a number of bores (see enlarged view) in the outer periphery of the nozzle 15 are exposed. Pressurized cleaning agent is pressed through the duct 21 up to the nozzle 15 and out through the bores between the duct 21 and the outer periphery of the nozzle 15. During subsequent steps of the cleaning, the nozzle 15 first flushes clean in the cavity 17 and thereafter the cavity 18, during rotation of the valve body 5. The valve body 5 can be rotated continuously or in steps in order to expose the cavities 17, 18 to the nozzle 15 and to evacuate cleaning agent through the outlet during both the first and the second step. It is also possible to have the first step carried out separately, alternatively to carry out the first and the second step simultaneously.

One example of the configuration of the nozzle 15 can be seen from the illustrated part-enlargement in FIG. 4. The nozzle 15 can comprise a front section having a plane face 22, which, in the retracted position, is intended to coincide with the front face 20 of the piston. Moreover, the nozzle 15 comprises a rear section of substantially conical basic shape, a seal. 23 in the form of a front conical face being intended to bear sealingly against a corresponding face 24 in the piston 13. The rear section of the nozzle 15 is provided with a number of radial and/or angled bores 25, 26, 27, which run between the central duct 21 in the rod 14 and the outer periphery of the rear conical section of the nozzle 15. Bores 25, 26, 27 having the same angle relative to the centre axis X of the rod 14 are placed such that their respective centre axes coincide on the centre axis X of the rod 14. According to the illustrated example, the periphery of the rear conical section is provided with outer radial grooves 28, 29, 30, in which the bores 25, 26, 27 emerge. Bores having the same angle relative to the centre axis X of the rod emerge in the same radial grooves. As can be seen from the part-enlargement in FIG. 4, bores 27 directed towards the valve body 5 emerge in grooves 30 closer to the end face 22 of the nozzle 15 than bores 26 directed at right angles to the centre axis X of the rod. The angle of the bores relative to the centre axis depends on their function during the cleaning. Bores 26 intended to clean the valve body 5 are placed along the front part of the rear section. These are directed forwards and can be given an angle of between 90° and the cone angle of the rear section relative to the centre axis X of the rod. Bores 25, 26 intended to clean the inner face 32 of the cylinder 12, and also the front face 20 of the piston 13, are preferably placed along the rear part of the rear section. These are directed outwards and can be angled at 90°, alternatively between 90° and 70°, relative to the centre axis of the rod, provided that this does not disturb jets situated in front thereof. As can be seen from the part-enlargement, the rearmost bores 25 can be angled obliquely rearwards in order to be able to flush the front face 20 of the piston 13.

Figure 5:
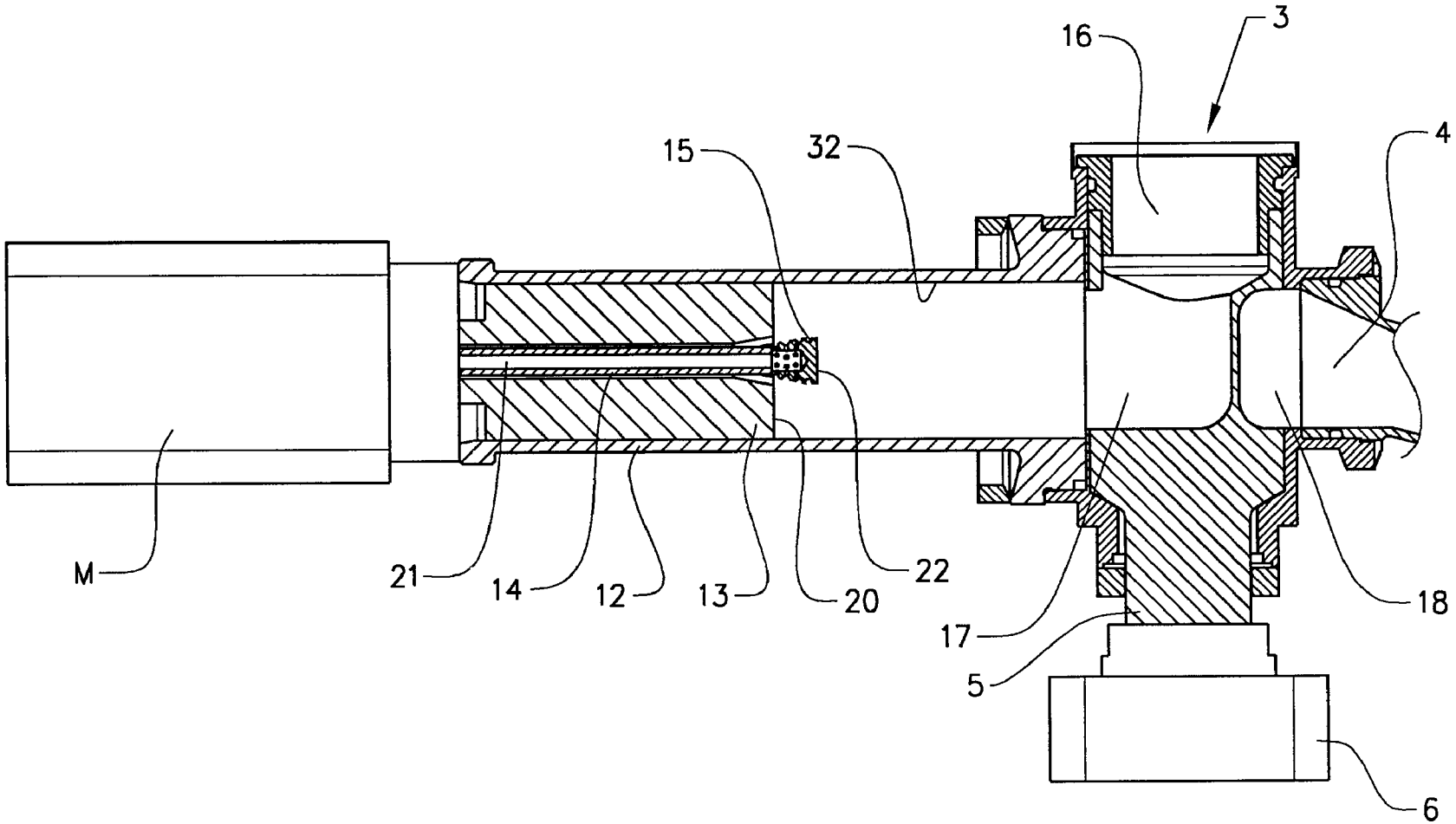
FIG. 5 shows an enlarged view of the cross section in FIG. 3, with the piston in a second position for cleaning.

FIG. 5 shows an enlarged view of the cross section in FIG. 3, with the piston in a second position for cleaning. In this figure, the piston 13 is placed in its rear end position, the nozzle 15, in its extended position, being directed towards the valve body 5 and the inner face 32 of the cylinder 12. During a first step of the cleaning of the cylinder 12, the piston 13 is pushed forwards in the direction of the valve body 5, while the inner face 32 of the cylinder 12 and the front face 20 of the piston are simultaneously flushed. Once the piston 13 in the next step reaches its front end position, the nozzle 15 first flushes clean in the cavity 17 and thereafter in the cavity 18, as the valve body 5 rotates. The valve body 5 can here be rotated continuously or in steps in order to expose the cavities 17, 18 to the nozzle 15. If necessary, the piston 13 can be drawn back into its rear end position, whereupon the cleaning process can be repeated. To enable used cleaning agent to be evacuated through the outlet 4, the valve body 5 is rotated for as long as flushing takes place through the nozzle 15.

Alternatively, the piston 13 can be rotated continuously during displacement through the cylinder 12, so that the jets of cleaning agent reach a larger area of the inner face 32 of the cylinder 12. This can be achieved by the control unit M being arranged to rotate the rod 14 about its centre axis. According to a further alternative, the front part of the nozzle 15 comprising the conical section with bores can be arranged to be rotated during the cleaning.

The invention is not limited to the above-stated embodiments, but can be varied freely within the scope of the below-stated patent claims.

The invention claimed is:

1. A metering pump for feeding out viscous materials, comprising:

a housing having an inlet, connectable to a viscous material source, and an outlet; a valve body of cylindrical basic shape, which is rotatable into at least two positions by means of a drive unit, a first position allowing a flow of the said material from the inlet to the housing and a second position allowing a flow of the said material from the housing to the outlet;

a cylinder device connected to the housing, having a controllable piston intended to achieve the said flow of material, and at least one device for cleaning the metering pump, including that the cleaning device comprises at least one nozzle for cleaning agent, disposed in a valve-body-facing part of the piston, and that the nozzle is disposed in an extended position in the piston while the metering pump is cleaned.

2. The metering pump according to claim 1, including that the nozzle is disposed in a retracted position in the piston when viscous materials are fed out.

3. The metering pump according to claim 1, including that at least one nozzle, in the extended position, is directed towards the valve body.

4. The metering pump according to claim 3, including that the nozzle, in the extended position, is directed towards an inner face of the cylinder device.

5. The metering pump according to claim 1, including that the valve body is arranged to be rotated during cleaning of the metering pump.

6. The metering pump according to claim 5, including that the valve body is arranged to be rotated continuously.

7. The metering pump according to claim 1, including that the valve body is arranged to be rotated into an intermediate position which allows flow between the inlet and the outlet during cleaning of the metering pump.

8. The metering pump according to claim 1, including that the piston is arranged to be disposed at a predetermined distance from the valve body during cleaning of the metering pump.

9. The metering pump according to claim 1, including that the piston is arranged so as to be displaceable relative to the valve body during cleaning of the metering pump.

10. The metering pump according to claim 1, including that the cleaning device comprises at least one nozzle for cleaning agent, disposed in the inlet.

11. The metering pump according to claim 1, including that the valve body is mounted rotatably relative to the housing in at least two axially separate positions.

12. The metering pump according to claim 11, including that the valve body is mounted rotatably relative to the housing adjacent to its ends.

13. The metering pump according to claim 1, including that the inlet is connected to an axial section of the valve body.

14. The metering pump according to claim 1, including that the outlet is connected to a radial section of the valve body.

15. The metering pump according to claim 1, including that the cylinder device is connected to a radial section of the valve body.

16. The metering pump according to claim 15, including that the valve body is mounted rotatably relative to the housing on each side of the cylinder device.

17. A device comprising:

a piston for a cylinder device intended to achieve a flow of viscous material in a metering pump for feeding out the said viscous material, the piston connected to a housing having an inlet, connectable to a viscous material source, and an outlet; a valve body which can be set in at least two positions, a first position allowing a flow of the said material from the inlet to the housing and a second position allowing a flow of the said material from the housing to the outlet;

the cylinder device being connected to the housing in order to achieve the said flow of material, where the piston comprises at least one cleaning device for the supply of cleaning agent for cleaning of the metering pump, including that the cleaning device comprises at least one nozzle for cleaning agent, disposed in a front part, facing the valve body of the piston, that the nozzle is disposed in a retracted position in the piston when viscous materials are fed out, and that the nozzle is disposed in an extended position in the piston while the metering pump is cleaned.

18. The device according to claim 17, including that at least one nozzle, in the extended position, is directed towards the valve body.

19. The device according to claim 18, including that the piston is disposed at a predetermined distance from the valve body during cleaning of the metering pump.

20. The device according to claim 18, including that the piston is arranged to be disposed so as to be displaceable in the direction of the valve body during cleaning of the metering pump.

21. The device according to claim 17, including that at least one nozzle, in the extended position, is directed towards an inner face of the cylinder device.

22. The device according to claim 21, including that the piston is arranged so as to be displaceable from a first end position into a second end position in the direction of the valve body.

23. The device according to claim 17, including that at least one nozzle is disposed at one end of a through-rod which is axially pushable in a piston rod in the cylinder device, which nozzle can be pushed out of the front face of the piston.

24. The device according to claim 23, including that the said through-rod is provided with a duct for cleaning agent.

25. The device according to claim 24, including that the duct emerges in a number of bores in the periphery of the nozzle, which bores, in the extended position of the nozzle, are exposed.

26. The device according to claim 17, including that at least one nozzle disposed at one end of a through-rod which is axially pushable in a piston rod in the cylinder device, which nozzle can be pushed into the front face of the piston.

27. The device according to claim 26, including that a gap between the said through-rod and an inner face of the piston rod constitutes a duct for cleaning agent.

28. The device according to claim 23, including that at least one nozzle is provided with a front rotatably mounted section having tangentially directed bores, which section is intended to rotate under the influence of flowing cleaning agent.

29. A method for cleaning a metering pump, comprising:

cleaning a metering pump, the metering pump including a housing having an inlet, connectable to a viscous material source, and an outlet; a valve body of cylindrical basic shape, which is rotatable into at least two positions by means of a drive unit, a first position allowing a flow of the said material from the inlet to the housing and a second position allowing a flow of the said material from the housing to the outlet; a cylinder device connected to the housing, having a controllable piston intended to achieve the said flow of material, and at least one device for cleaning the metering pump, including that the cleaning device comprises at least one nozzle for cleaning agent, disposed in a valve-body-facing part of the piston, and that the nozzle is disposed in an extended position in the piston while the metering pump is cleaned, the method including, shutting-off of the inlet connected to the viscous material source;

controlling of the valve body to allow simultaneous supply of cleaning agent from the inlet and draining-off of cleaning agent through the outlet;

controlling of the nozzle into a position in which the nozzle allows cleaning of the metering pump;

connection of the inlet to a pressurized cleaning agent source;

connection of the nozzle to a pressurized cleaning agent source; and flushing of the valve body and at least a part of the cylinder device.

30. The method for cleaning a metering pump according to claim 29, including that the method comprises controlling of the valve body into an intermediate position which connects the inlet and the outlet.

31. The method for cleaning a metering pump according to claim 29, including that the method comprises controlling of the valve body by rotation of the latter in order intermittently to connect the inlet and the outlet.

32. The method for cleaning a metering pump according to claim 29, including that the method comprises opening of a nozzle in the front part, facing the valve body, of the piston.

33. The method for cleaning a metering pump according to claim 32, including that the method comprises opening of a nozzle by the action of a through-rod which is axially pushable relative to a piston rod in the cylinder device.

34. The method for cleaning a metering pump according to claim 29, including that the method comprises flushing of the valve body and at least a part of the cylinder device with displacement of the piston in the direction of the valve body.

35. The method for cleaning a metering pump according to claim 29, including that the method comprises flushing by means of a cleaning agent in a first step and drying by means of a pressurized gas in a second step.

36. The metering pump according to claim 14, including that the cylinder device is connected to a radial section of the valve body.

* * * * *

UNITED STATES PATENT AND TRADEMARK OFFICE

CERTIFICATE OF CORRECTION

PATENT NO. : 8,366,422 B2
APPLICATION NO. : 12/439797
DATED : February 5, 2013
INVENTOR(S) : Jan Sjögren It is certified that error appears in the above-identified patent and that said Letters Patent is hereby corrected as shown below:

On the title page, in column 1, under "(22) PCT Filed", line 1, delete "Sep. 9, 2007" and insert --Sep. 7, 2007--, therefor Signed and Sealed this
Seventh Day of May, 2013

Teresa Stanek Rea

Teresa Stanek Rea
*Acting Director of the United States Patent and Trademark Office*

UNITED STATES PATENT AND TRADEMARK OFFICE

CERTIFICATE OF CORRECTION

PATENT NO. : 8,366,422 B2
APPLICATION NO. : 12/439797
DATED : February 5, 2013
INVENTOR(S) : Jan Sjögren It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 881 days.

Signed and Sealed this
First Day of September, 2015

Michelle K. Lee

Michelle K. Lee
*Director of the United States Patent and Trademark Office*